US005082318A

United States Patent [19]

Held et al.

[11] Patent Number: 5,082,318

[45] Date of Patent: Jan. 21, 1992

[54] GIRTH HITCHING MECHANISM

[75] Inventors: Jimmy L. Held; Charles E. Tallerino; Ronald S. Reich, all of San Diego, Calif.

[73] Assignee: The United States of America as represented by the Secretary of the Navy, Washington, D.C.

[21] Appl. No.: 604,727

[22] Filed: Oct. 26, 1990

[51] Int. Cl.[5] ..... B25J 1/00; B63B 21/04

[52] U.S. Cl. ..... 294/19.1; 114/221 R; 289/17

[58] Field of Search ..... 294/19.1, 66.1; 114/221 R, 230; 119/151, 153; 289/6, 8, 17, 18.1

[56] References Cited

U.S. PATENT DOCUMENTS

| | | | |
|---|---|---|---|
| 1,470,861 | 10/1923 | Meyer | 289/18.1 X |
| 1,830,208 | 11/1931 | Norling | 289/17 X |
| 1,855,541 | 4/1932 | Bamkin | 289/18.1 X |
| 1,972,520 | 9/1934 | Haynes | 289/18.1 |
| 2,347,718 | 5/1944 | Terry | 294/19.1 |
| 2,517,461 | 8/1950 | Carlile | 289/18.1 |
| 2,550,770 | 5/1951 | Calemmo | 294/19.1 X |
| 2,813,736 | 11/1957 | Archer et al. | 289/17 |
| 3,072,429 | 1/1963 | Stipan | 294/19.1 |
| 3,813,122 | 5/1974 | Wemyss | 294/19.1 |

*Primary Examiner*—Johnny D. Cherry

*Attorney, Agent, or Firm*—Harvey Fendelman; Thomas Glenn Keough

[57] ABSTRACT

A girth hitch is secured about an object by a girth hitching mechanism having a rotatable actuator gate which displaces a latch gate that has a parrot hook that loosely supports a portion of a closed girth loop. A latch ring joined to the girth loop by a latch ring bite is engaged by the parrot hook when the latch gate and actuator gate are rotatably displaced as the object enters the throat of a fork which supports the latch gate, actuator gate and latch ring. After the parrot hook engages the latch ring and the latch gate is rotated in the opposite direction by the object to disengage the latch ring, the girth loop is pulled from its loose support on the parrot hook into a girth hitch configuration about the object to enable its recovery via an attached lift line.

16 Claims, 13 Drawing Sheets

GIRTH HITCHING MECHANISM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A wide variety of cable and line wrapping techniques have been used to retrieve and recover objects both on land and underwater. A number of devices for attaching a line have been attempted that show varying degrees of success, but, as a general rule, they tend to be too complicated and the engaging interconnection could be improved upon.

The well-known girth hitch is a secure proven attachment and has been in use since antiquity for securing a line to an object or for suspending a load via a line. Other than tying the hitch by hand, most devices and methods of affixing a girth hitch have required access to either one or the other end of the object. Usually, a girth hitch would be tied away from the object, mounted on some sort of a bracket, and then slipped over one of the ends or projections of the object. Clearly this approach would not work when a closed loop or other projectionless object was to be engaged. Attachment via the somewhat reliable clove hitch knot met with similar limitations since the clove hitch line had to be wrapped completely around the object twice. This wrapping procedure is usually not a tolerable luxury when trying to secure to an object in a difficult location, such as one which is at extreme ocean depths where, perhaps, only a closed loop structure is available for connection. Furthermore, the known girth hitch attachment techniques require several sequential manipulations of the hitching line which simply cannot be performed in numerous situations.

Thus, a continuing need exists in the state of the art for a mechanism for attaching a girth hitch by merely moving a mechanism toward the object to be engaged and backing away from the object to affix the girth hitch so that an interconnected lift line can effect recovery.

SUMMARY OF THE INVENTION

The present invention is directed to providing a girth hitch secured about an object by a girth hitching mechanism. The mechanism has a rotatable actuator gate which displaces a latch gate that has a parrot hook that loosely supports a portion of a closed girth loop. The mechanism also includes a latch ring joined to the girth loop by a latch ring bite which is engaged by the parrot hook when the latch gate and actuator gate are rotatably displaced as the mechanism travels toward the object and the object enters the throat of a fork which supports the latch gate, actuator gate and latch ring. After the parrot hook engages the latch ring and the latch gate is rotated in the opposite direction by the object to disengage the latch ring, the girth loop is pulled from its loose support on the parrot hook into a girth hitch configuration about the object to enable its recovery via an attached lift line.

An object of the invention is to provide a mechanism for engaging an object via a girth hitch.

Another object is to provide a mechanism which easily attaches a line to an object such as a helicopter rotor, underwater cable on the sea floor, leg of an oil platform, torpedo body, objects floating on the surface of the ocean, etc., to be recovered by a girth hitch attachment.

Another object is to provide a mechanism suitable for engaging a closed loop structure to effect the engagement thereof in a girth hitch.

Still another object is to provide a mechanism for affixing a girth hitch suitable for hand-held application, for inclusion on a manned or unmanned submersible manipulator, for attachment via a ship boat hook-type structure, or for an attachment device in space.

Still another object is to provide a device for attaching a girth hitch to an object that is attached by a straight motion toward and away from the object.

Yet a further object is to provide a mechanism for attaching a girth hitch that is completely automatic without separate actuation of triggers or levers to effect the hitching action.

Still a further object is to provide for the ability to tie a line to any object that a line can be put around, including a closed loop or ring structure.

A further object is to provide a mechanism for attaching a girth hitch capable of being built to a desired size to suit a specific application.

These and other objects will become more readily apparent from the ensuing specification and claims when taken in conjunction with the appended claims.

DESCRIPTION OF THE PREFERRED EMBODIMENT

Figure 1:
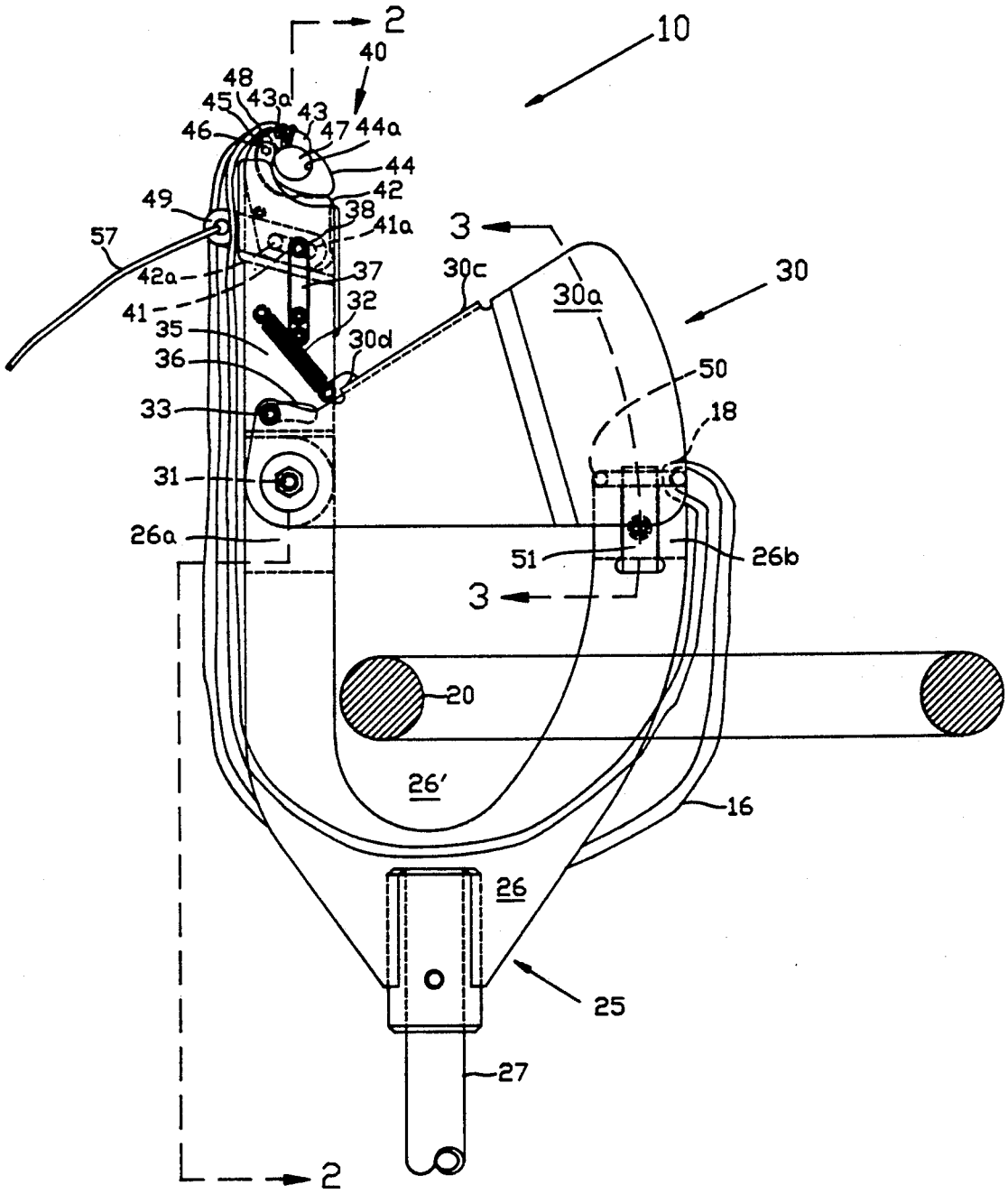
FIG. 1 is a side view of a representative embodiment of the invention.
Figure 2:
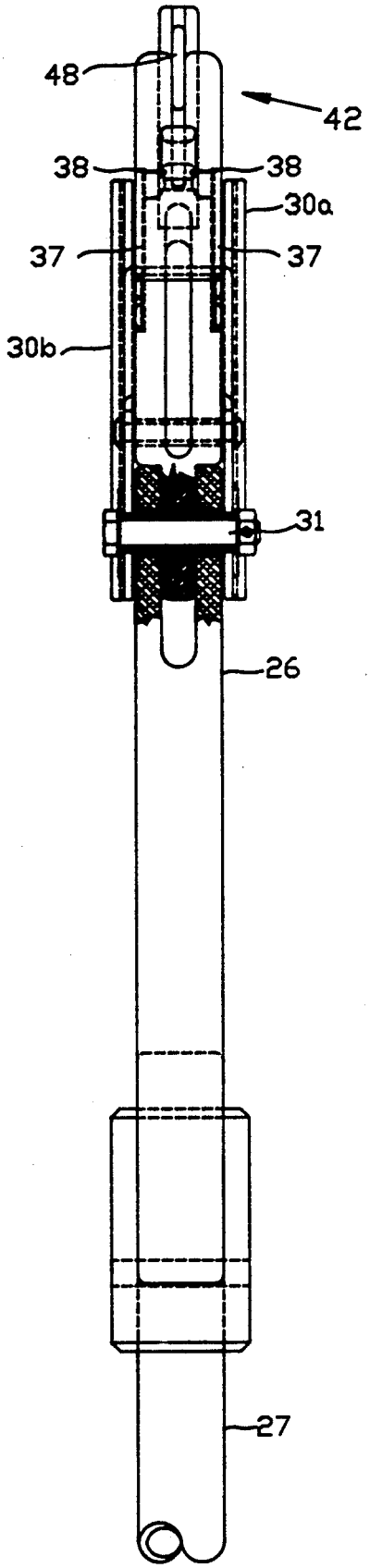
FIG. 2 is a partial cross-sectional view of the latch gate, actuator gate and part of the fork of the invention taken generally along lines 2—2 in FIG. 1.
Figure 4:
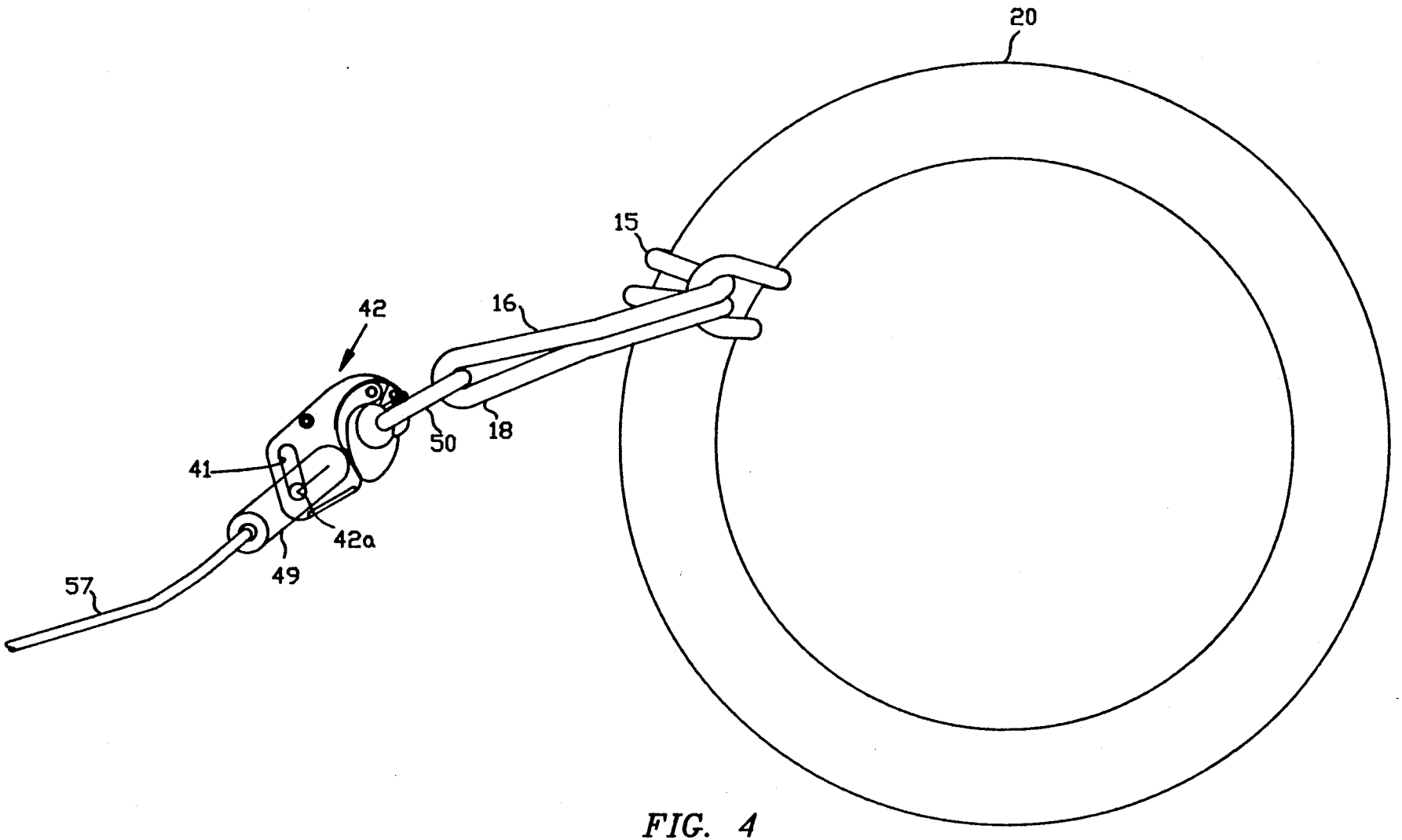
FIG. 4 shows an isometric view of a girth hitch engaging an object to be recovered.

Looking now to FIG. 1, a girth hitch mechanism 10 has been designed to assure the attachment of a girth hitch 15 to an object 20 and to enable its eventual recovery, see FIG. 4. The girth hitch is a well-known knot configuration which has been used since antiquity to engage an object or to secure a lift line 57 to it. Some of the advantages of such a hitch are that it has the capability to increase its grip on an engaged object without overly stressing the line used to make the hitch. It is a relatively uncomplicated knot that is easily tied and untied after the useful purpose has been completed.

The elements of girth hitch mechanism 10 are fabricated from materials which inherently possess sufficient strength to accomplish the task at hand. Having the teachings of this disclosure, one skilled in the art can tailor the size of the mechanism, the selection of elements used for fabrication and the relative ruggedness of the elements, to accommodate a task at hand. For example, this flexibility enables its use in the hostile marine environment (which, therefore, at least suggests that corrosion resistant or noncorrosive materials be selected) or an outer space application where the requirements are for light-weight, strong structures not affected by extreme temperature changes and the vibrations attendant a launch. These considerations and the appropriate selection of materials and sizes are clearly apparent to designers and technicians so that the disclosed girth hitching mechanism can have a universal application.

Girth hitching mechanism 10 includes a fork assembly 25 that has an essentially U-shaped member 26 having leg portions 26a and 26b mounted on a shaft 27. The shaft may be supported by a manual operator, a manned or unmanned terrestrial, underwater or space vehicle, not shown, or any other appropriate machinery that has the capability for suitably imparting an outward and inward motion with respect to object 20 with a sufficient force to enable an engaging of the mechanism with the object. Once an object 20 has been suitably located to be placed in an approximately coaxial extension of shaft 27, the only mechanical coaction required to effect a girth hitch 15 about object 20 is a simple axial approaching displacement of shaft 27 toward the object and then, after object 20 is taken to a position within fork throat 26', an axial withdrawing displacement from object 20 in the opposite direction by shaft 27 is all that is needed to secure object 20 with girth hitch 15.

An actuator gate 30 is rotatably secured onto leg portion 26a of U-shaped member 26 by a gate hingepin bolt 31 and is provided with sides 30a and 30b joined by connector portion 30c. The connector portion acts as a bearing surface for object 20 during the actuation sequence, to be described below, and also acts as a stop at 30d to prevent counterclockwise rotation by the actuator gate due to the force exerted by a gate spring 32. An actuator gate drive pin 33 is free for limited rotation in a latch gate slot 36 shaped in both sides 30a and 30b of actuator gate 30 to provide for a selective engagement of a latch gate 35.

Latch gate 35 partially functions to secure a parrot hook assembly 40 onto its distal end via a pair of nipple leaf springs 37 that are appropriately attached to its opposite sides, only one of the nipple leaf springs being shown in FIG. 1 of the drawings. Each of the nipple leaf springs has an inwardly facing nipple 38 which engages a hook slot 41 in parrot hook assembly 40. Together, both of the nipple leaf springs exert a converging biasing force which each urges a tapered nipple 38 into hook slot 41 to releaseably secure parrot hook assembly 40 on latch gate 35.

Parrot hook assembly 40 is made up of a hook body 42 shaped with a hook 43 and provided with a latch 44 rotatably secured on the hook body by a latch pin 45 that is biased by a latch spring 46. Latch 44 thusly is held in a normally closed position against hook 43 to define a parrot hook eye 47. A projection 48 provides a support to hold a hook bite portion 17 of girth loop 16 on parrot hook assembly 40 for the reasons to be explained below.

Figure 3:
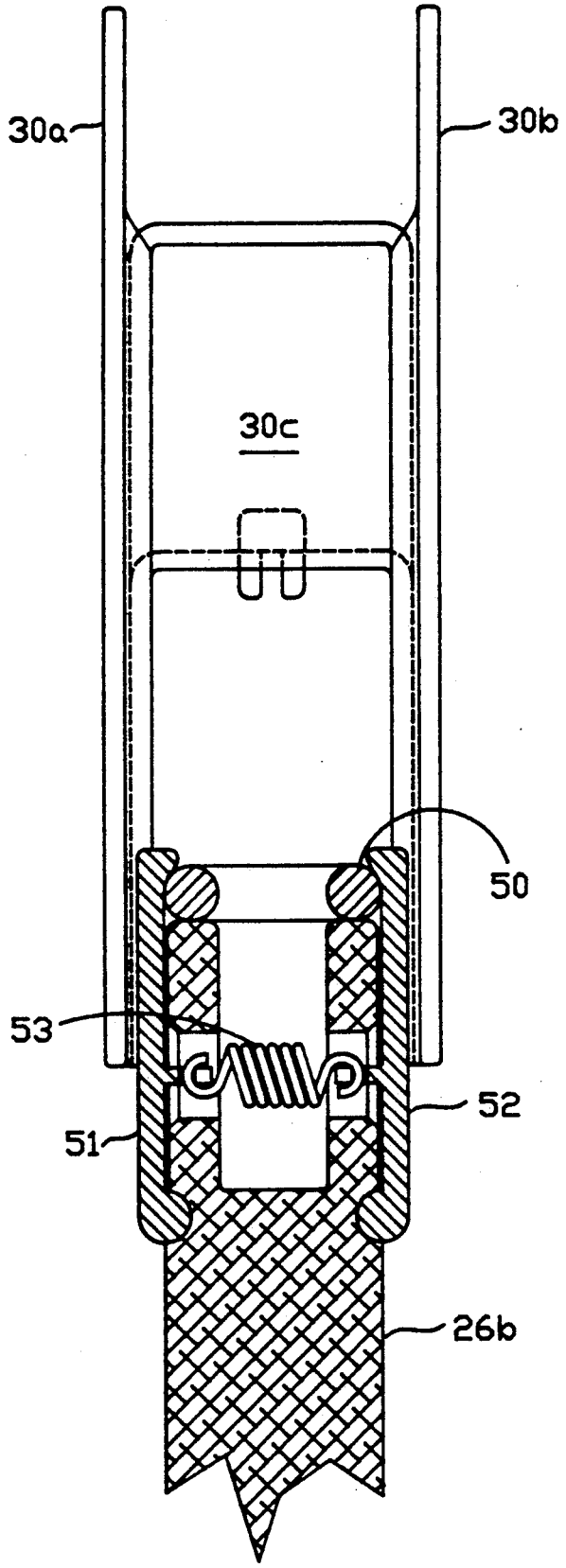
FIG. 3 is a cross-sectional view of the latch ring keeper and ring on the fork taken generally along lines 3—3 in FIG. 1.

Leg portion 26b of U-shaped member 26 is appropriately shaped to laterally support a latch ring 50 which is connected to a latch ring bite 18 of girth loop 16, see FIGS. 1 and 3. Latch ring 50 is held in its laterally supported relationship by a pair of latch ring keepers 51 and 52. Both of the latch ring keepers are held in their releasable engagement of latch ring 50 by an interconnected latch ring keeper spring 53. When a sufficient force is exerted to pull the latch ring from the latch ring keepers, in a manner to be elaborated on below, the latch ring cams apart the latch ring keepers and the retaining biasing force of the latch ring keeper spring is overcome.

Figure 13:
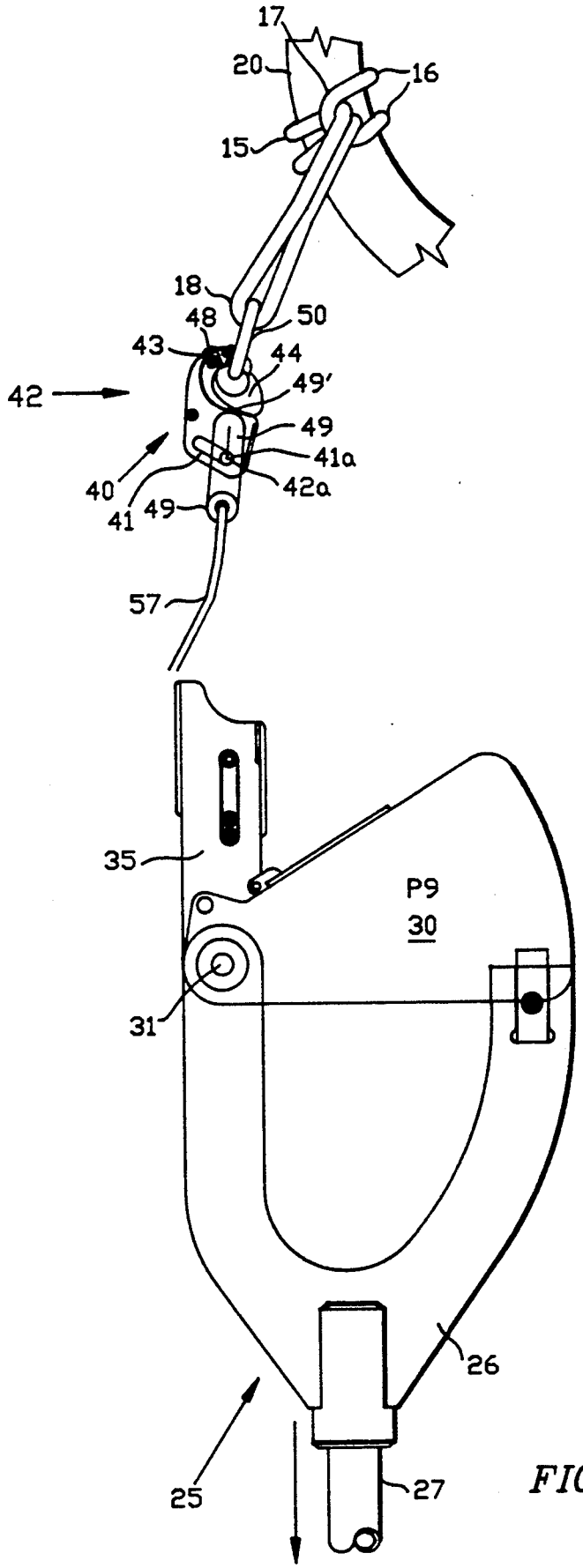

Parrot hook assembly 40 further is provided with a lift bracket 49 shaped with a hook slot 41. The lift bracket is connected to hook body 42 via a traverse hook pin 42a which slidably fits within hook slot 41. The lift bracket is held within latch gate 35 with tapered nipples 38 of nipple leaf springs 37 and is connected to a lift line 57 and provides for a mechanical coupling between the lift bracket and the hook body via traverse hook pin 42a. The location of pin 42a and the orientation of hook slot 41 are such as to transfer a lifting force through portion 41a of the hook slot to line 57 via hook 43 after a girth hitch has been formed and attached to an object about to be recovered, see FIG 13.

Girth hitch mechanism 10 of FIGS. 1 through 4 has been specifically designed to allow the attachment of a girth hitch 15 that is formed from girth loop 16. The girth loop is held on the girth hitch mechanism via a hook bite portion 17 and a latch ring bite portion 18 which are integral with those portions of the girth loop which reach therebetween and, generally, hang along leg portions 26a and 26b and on opposite sides of U-shaped member 26. Possibly, a couple of pieces of paper masking tape or light string might be used to loosely hold the interconnecting portions of the girth loop on opposite sides of U-shaped member 26.

A girth hitch attachment to an object only requires that the object be approached by the girth hitch mechanism and that inward and outward motion be transmitted via shaft 27. Object 20 has been portrayed herein as a ring-shaped object, partially to show a unique capability of this invention which is that it facilitates an attachment of a girth hitch to a closed loop structure. The object could be a stanchion or other structural member as long as it is no larger than the lateral dimension of fork throat 26' of U-shaped member 26.

Figure 5:
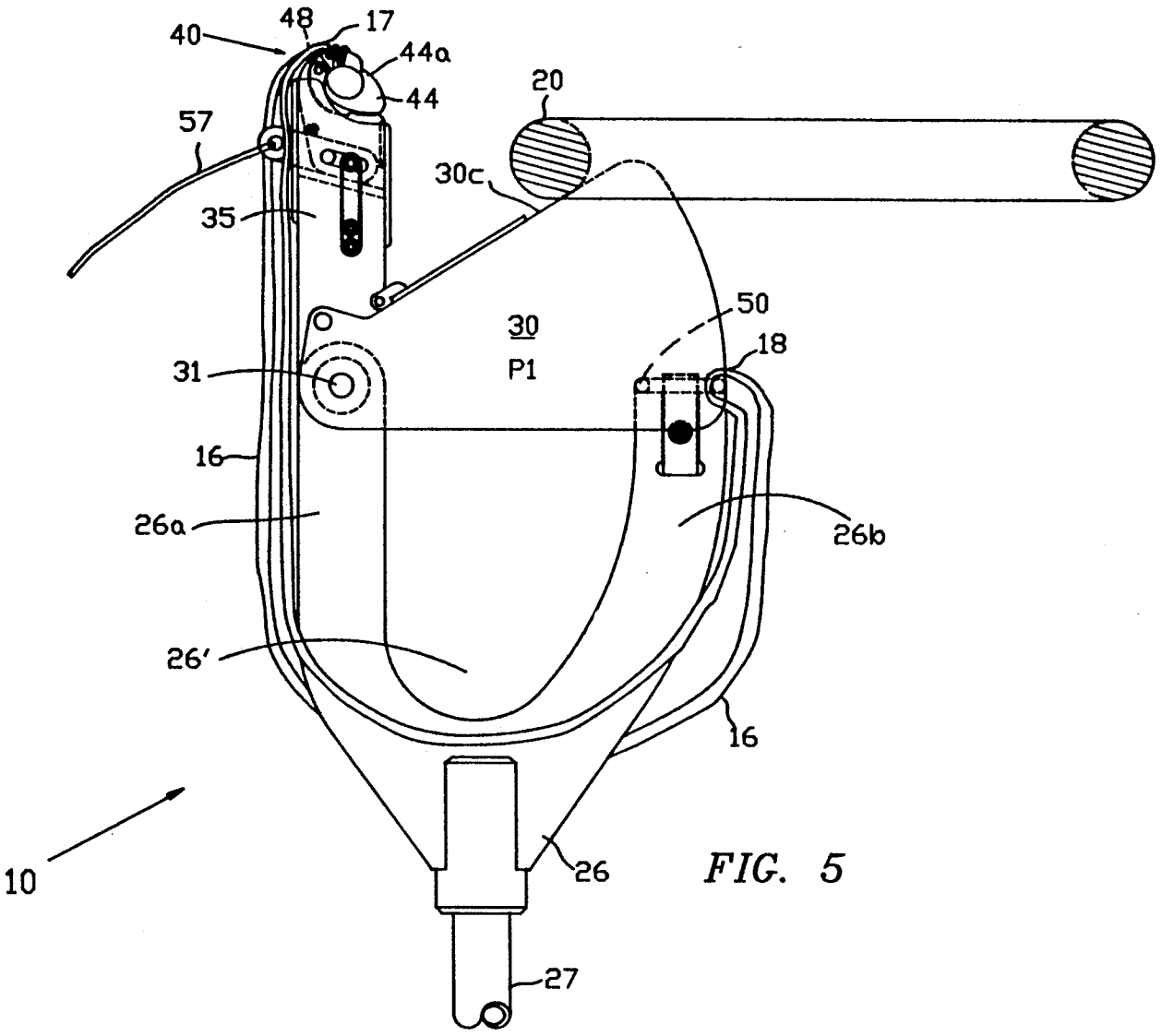
FIGS. 5-13 depict the sequence of attaching a girth hitch on an object to be recovered.
Figure 6:
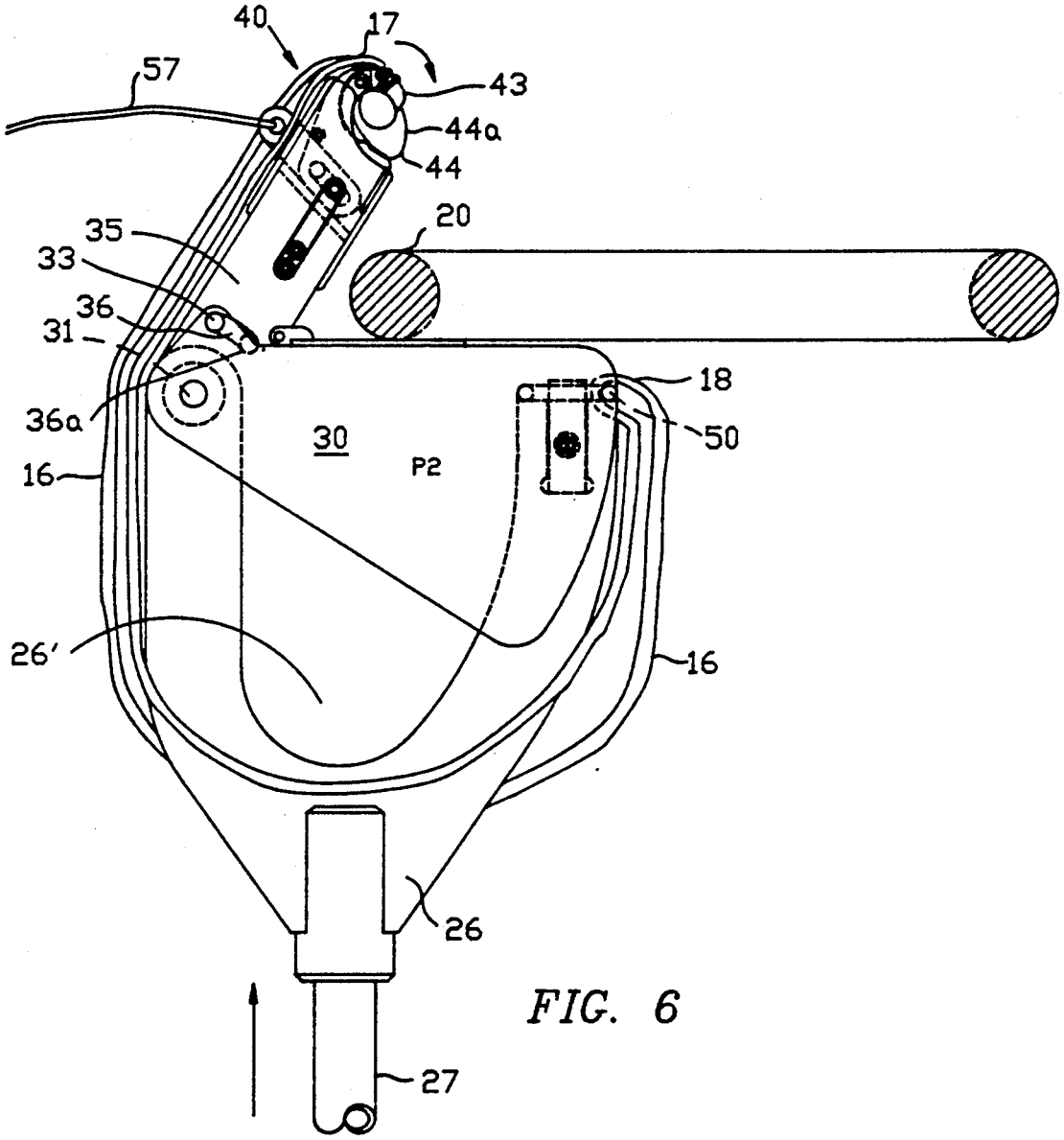
Figure 7:
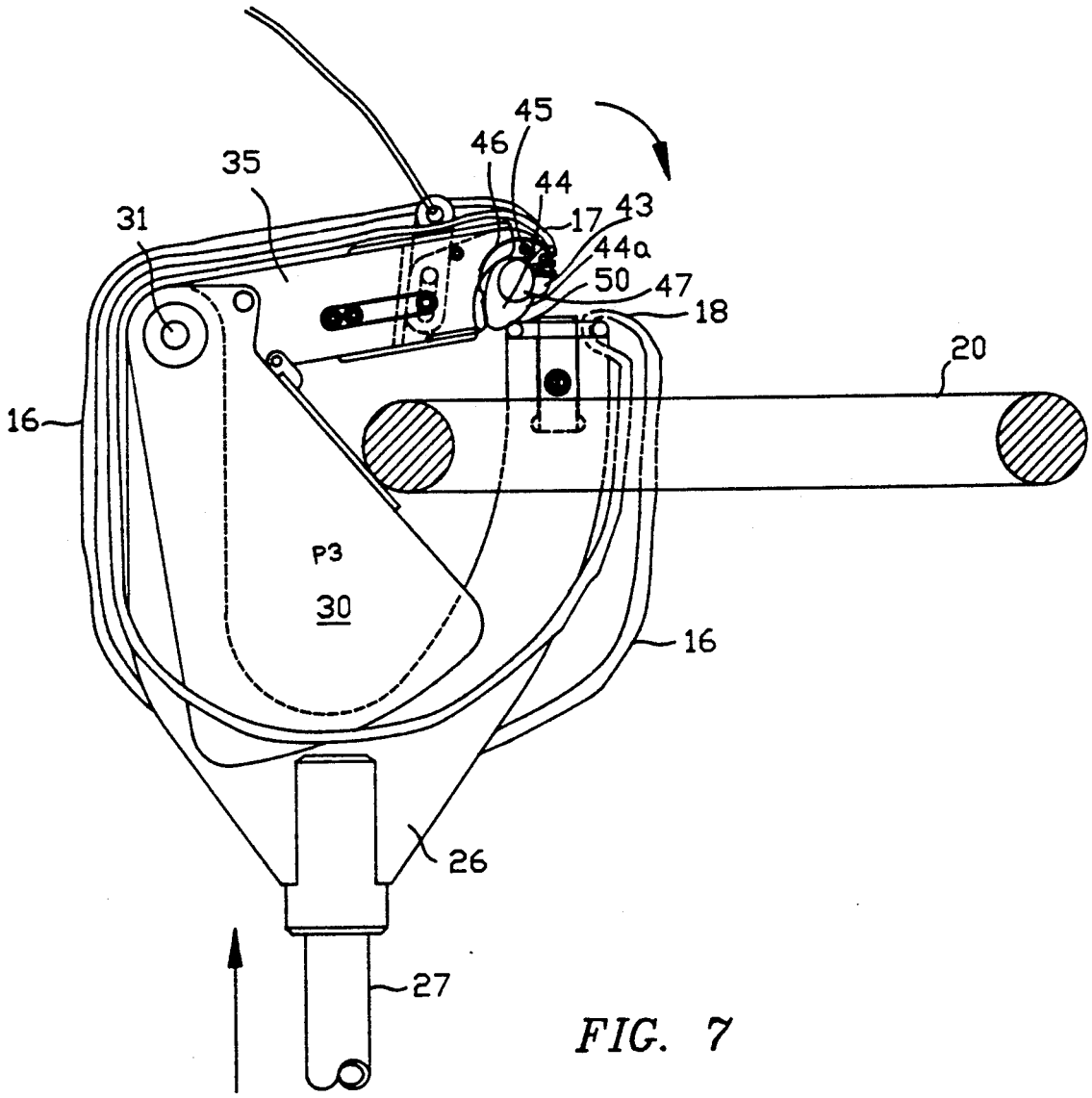

Referring to FIG. 5, an object 20 to be recovered is approached by girth hitch mechanism 10. The mechanism is so located that connector portion 30c of actuator gate 30 abuts object 20. As the girth hitch mechanism is moved toward object 20, actuator gate 30 is pivoted about gate hingepin bolt 31. Further inward motion of the mechanism toward the object, see FIGS. 6, 7 and 8, further rotates the actuator gate and allows object 20 to gain access to a position within fork throat 26'.

During this action, actuator gate pin 33 moves in the inclined latch gate slot 36 until it reaches the right end 36a of latch gate slot 36. This causes a coupling of a rotational force to latch gate 35 so that it too rotates in the arrow direction shown in FIGS. 6, 7 and 8. As object 20 approaches and occupies fork throat 26a', latch pressure surface 44a of latch 44 comes in contact with latch ring 50, see FIG. 7. Latch 44 is rotatably coupled to hook 43 of parrot hook assembly via a latch hingepin 45 and is held by a latch spring 46 in the parrot hook assembly to define a parrot hook eye 47. Further rotation of actuator gate 30 beyond the position indicated by FIG. 7 begins to rotate latch 44 in a clockwise direction about latch hingepin 45 as the latch is cammed away by bearing against latch ring 50. This begins to open parrot hook eye 47 and latch ring, 50 starts to enter the area of the parrot hook eye. As shaft 27 continues to move toward object 20, continuing pressure from object 20 on actuator gate 30 causes gate spring 32 to create a force sufficient to overcome the biasing force of latch spring 46 so that latch ring 50 pushes past latch 44 and enters parrot hook eye 47 of parrot hook assembly 40, see FIG. 8.

After latch ring 50 has completely entered parrot hook eye 47, latch spring 46 rotates latch 44 in a counter-clockwise direction about latch hingepin 45 until latch 44 closes about latch ring 50 and thereby connects the latch ring to parrot hook assembly 40.

Figure 8:
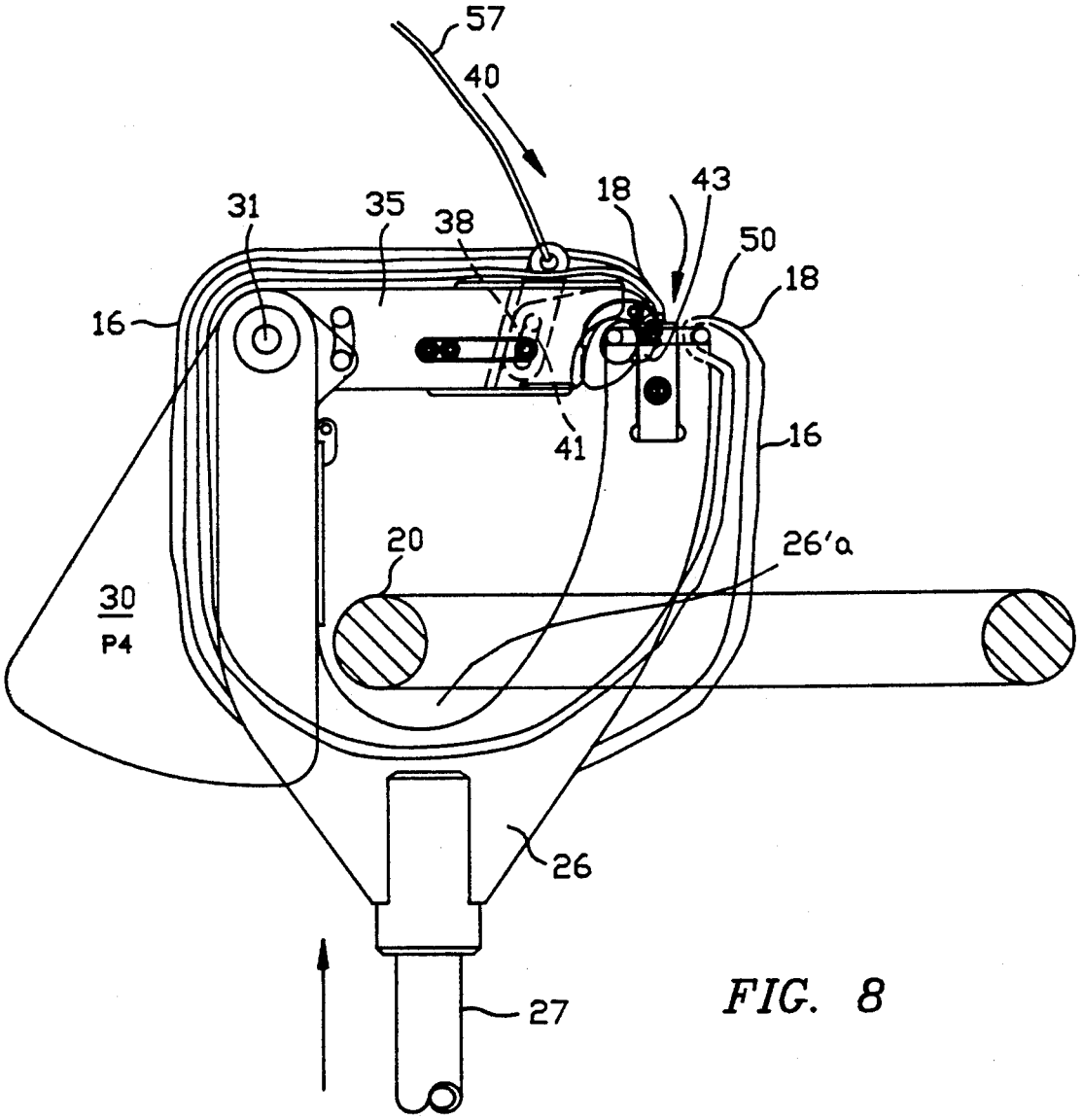

Since the parrot hook assembly is connected to hook bite portion 17, this part of the girth loop 16 will be firmly attached to the latch ring which is connected to the latch ring bite 18 of the girth loop 16, see FIG. 8.

Figure 9:
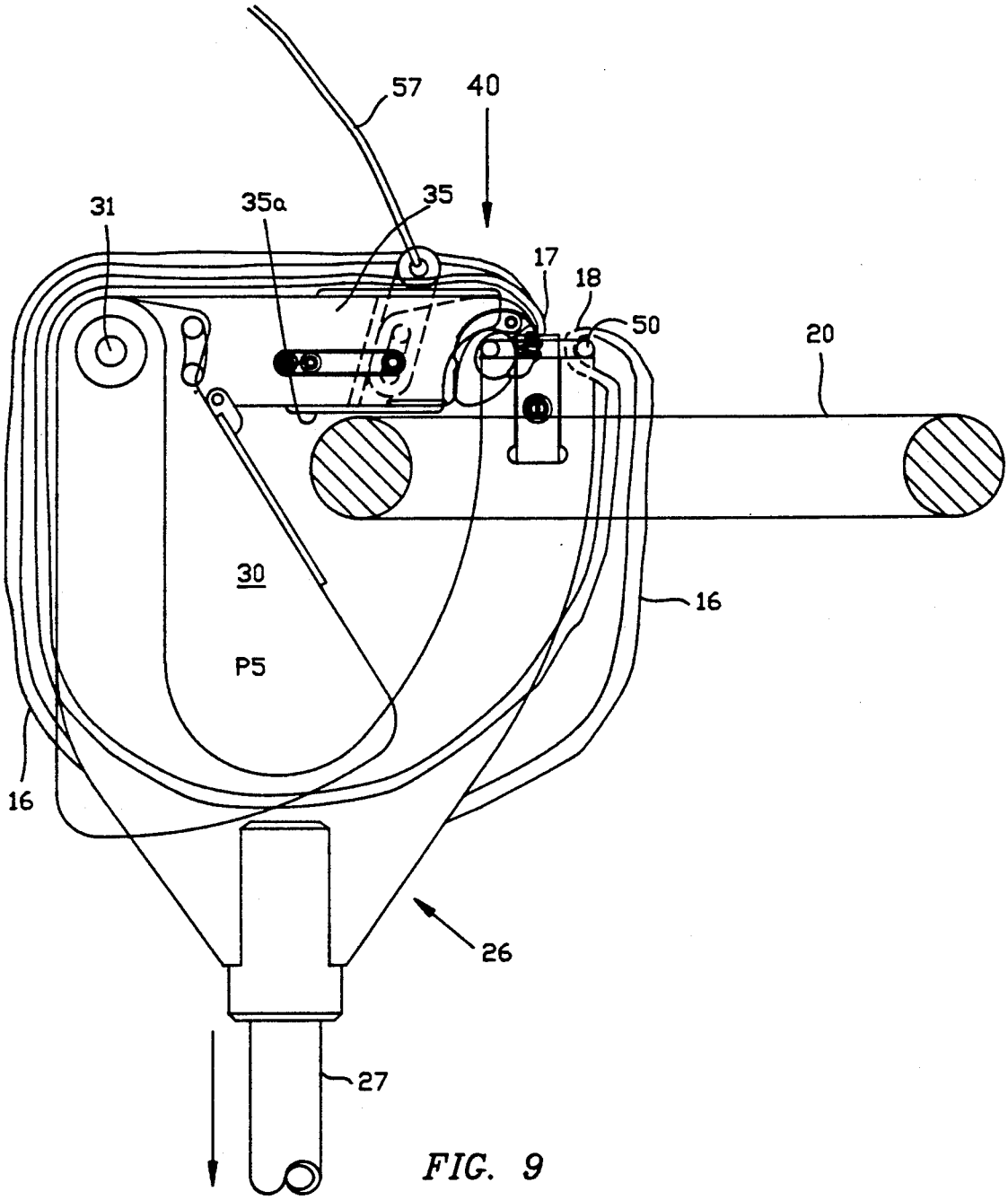
Figure 10:
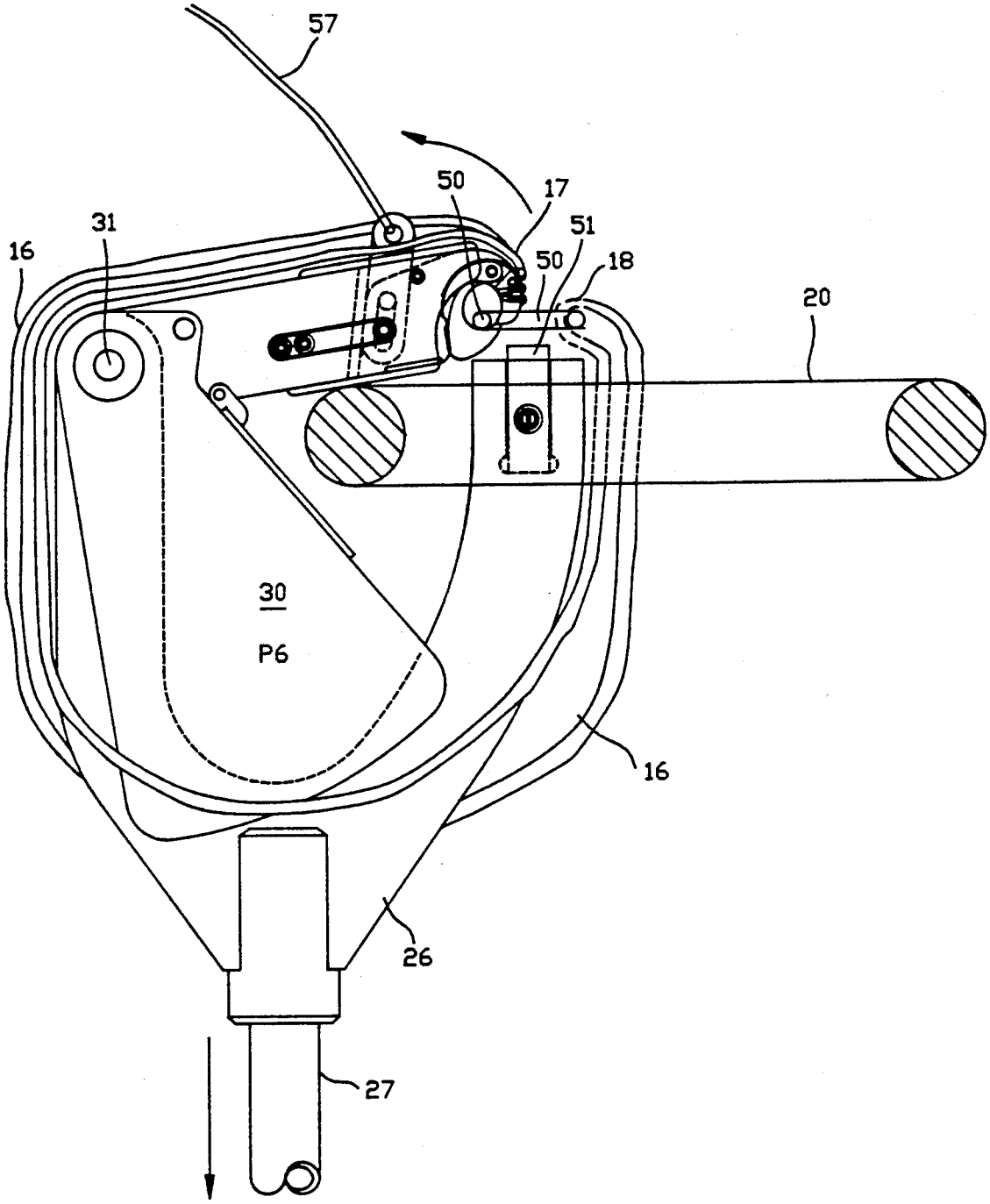
Figure 11:
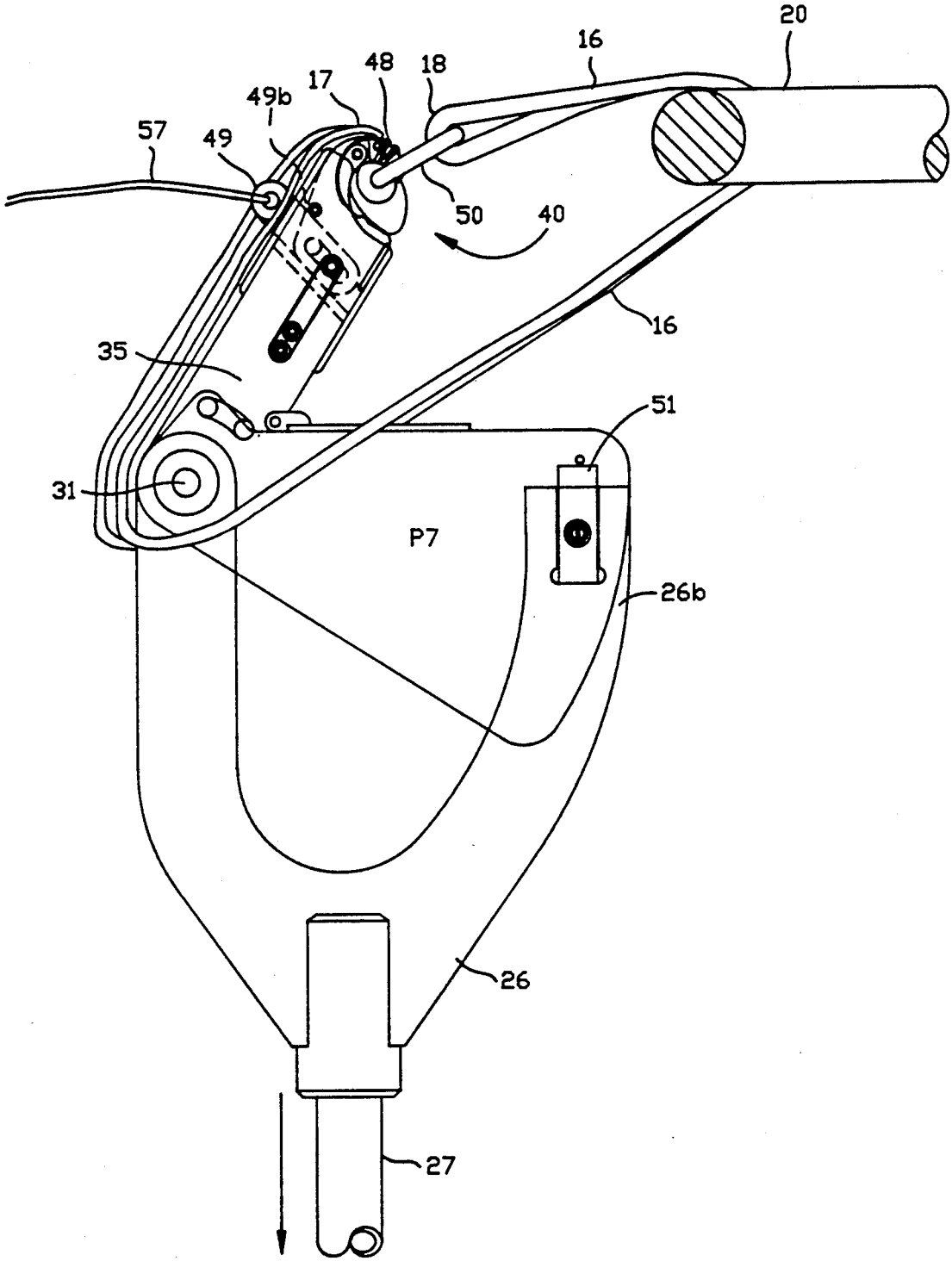

Completion of the girth hitch requires a withdrawal of shaft 27 so that object 20 applies pressure to an inside surface 35*a* of latch gate 35, see FIG. 9. Further withdrawal of the girth hitch mechanism via shaft 27 in the arrow direction as shown in FIG. 10 causes object 20 to bear against inside surface 35*a* of latch gate 35 and rotate latch gate 35 with parrot hook assembly 40 in a counterclockwise direction about gate hingepin bolt 31. Since latch ring 50 is retained within a curve portion 44*a* of latch 44 within parrot hook eye 47, latch ring 50 will be pulled from its latch ring keepers 51 and 52 as the biasing force of the latch ring keeper spring 53 is overcome. More withdrawal of the girth hitch mechanism by shaft 27 in the arrow direction shown in FIG. 10 will completely free latch ring 50 from latch ring keepers 51 and 52 so that, upon even further withdrawal of rod 27, object 20 will begin to be wrapped in girth loop 16, see FIG. 11.

Figure 12:
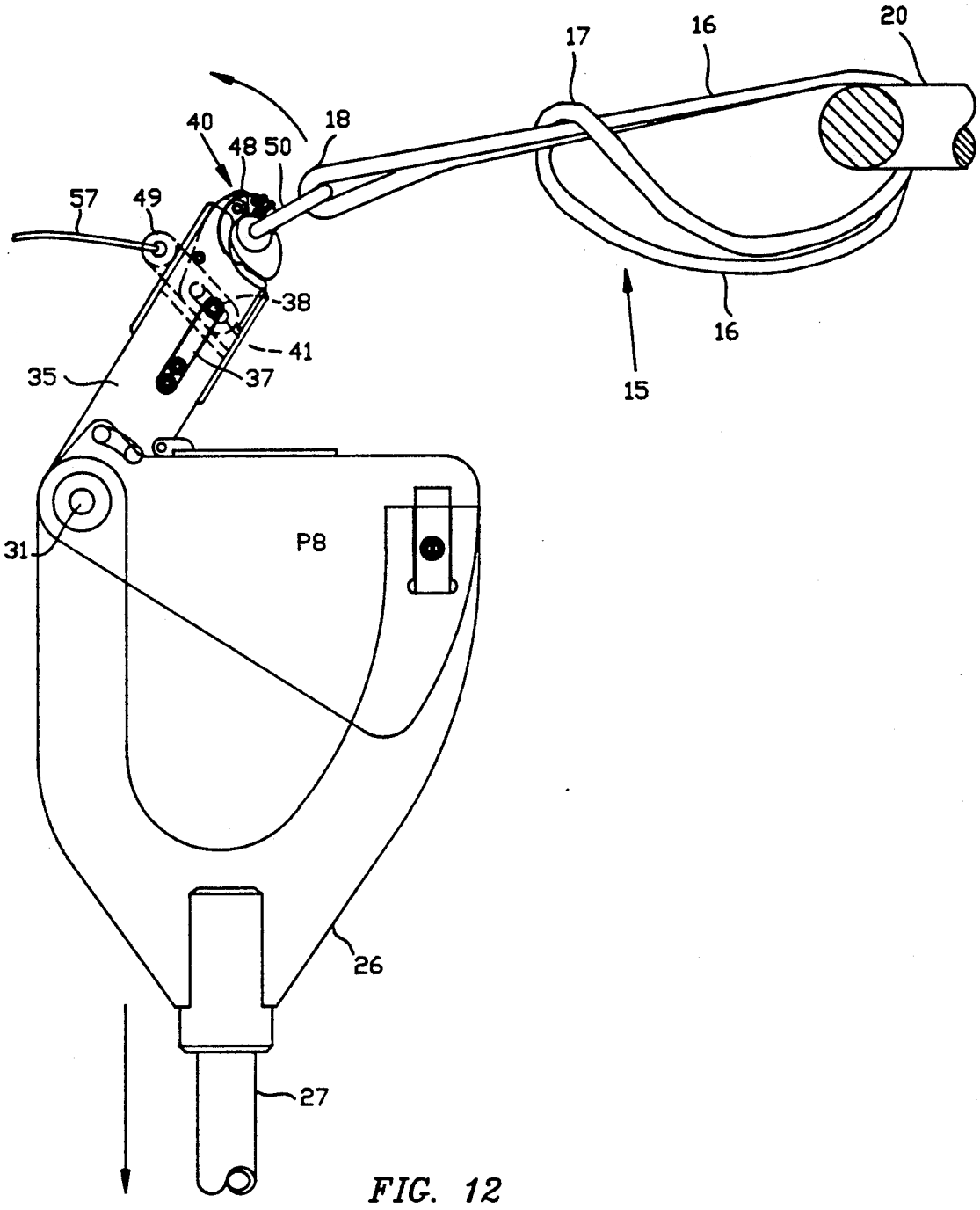

As shaft 27 continues to pull away from object 20 in the indicated arrow direction, the appearance of girth hitch 15 begins to materialize as depicted in FIG. 12. A further pulling away by shaft 27 in the indicated arrow direction begins to translate a displacing pressure against nipples 38 of both the nipple leaf springs 37 that cams them out of hook slot 41. Additional withdrawal of shaft 27 pulls the girth hitch mechanism so that the nipples 38 from the two nipple leaf springs 37 disengage from hook slot 41 of parrot hook assembly 40.

The parrot hook assembly 40 attached to girth loop 16 via latch ring 50 is now separated from fork assembly 25, actuator gate 30 and latch gate 35. Applying tension to lift line 57 causes hook bite 17 to break away from projection 43*a* on hook 43, allowing parrot hook assembly 40, latch ring 50 and latch ring bite 18 to pass through hook bite portion 17 and the formation of a girth hitch 15 attached to object 20.

Withdrawal of lift line 57 effects a transmission of this tension to a lift bracket 49 that rotates it about its hook pin 42*a* as the hook pin slides to end 41*a* of hook slot 41. This provides a nesting position at end 49' of lift bracket 49 which abuts or nearly abuts latch 44 to prevent disengaging rotation and thereby creates a positive closed lock of parrot hook eye 47.

A girth hitch mechanism fabricated as disclosed herein has the capability for easily tying a line to objects such as helicopter rotors, underwater cables on the sea floor, the leg of an oil platform, an underwater ordnance, objects floating on the surface of the ocean needing to be recovered, a closed ring such as a pad eye or a "D" ring, or even the yard of a sailboat. The mechanism herein disclosed can be mounted on manned or unmanned submersible manipulators, a ship's boathook, or even the manipulator of a space shuttle, for example. An operator of the device need not impart movement in any other direction than a straight line toward the object and then directly away from the object. No additional triggers need to be pulled or levers thrown and the hitching action is completely automatic. The girth hitch mechanism provides an ability to tie a line to any object that a line can be put around. In the case of a closed loop or ring, the inside diameter of the ring needs to be large enough to allow latch gate 35 or leg portion 26*b* to pass through until the ring, or object to be recovered, is nestled in fork throat 26'. The girth hitch mechanism is capable of being fabricated from appropriate material in any size to suit a specific application. The size of the mechanism depends on the size object that can fit entirely within fork throat 26' and the mechanism can be scaled accordingly.

Obviously, many modifications and variations of the present invention are possible in the light of the above teachings. It is therefore to be understood that within the scope of the appended claims, the invention may be practiced otherwise than as specifically described.

We claim:

1. An apparatus for making a girth hitch from a girth loop on an object comprising:

means for supporting provided with a throat sized to receive said object therein between one side surface and an other side surface;

means rotatably mounted at said one side surface of the supporting means for responsively rotating when displaced in one direction by said object;

means provided at said other side surface of said supporting means for releaseably holding a latch ring element;

means mounted on the responsively rotating means having a hook element for engaging said latch ring element of the releaseably holding means when said responsively rotating means is displaced in said one direction by said object entering said throat; and a girth loop carried on said supporting means having a latch ring bite portion connected to said latch ring element and a hook bite portion supported on said engaging means, whereby as said object displaces said engaging means in a different direction, said hook element of said engaging means disengages said latch ring element from said releaseably holding means, said hook bite portion of said girth loop is pulled free of said engaging means and said girth loop is pulled from said supporting means to form said girth hitch on said object.

2. An apparatus according to claim 1 in which said supporting means is configured to move toward said object to cause said object to displace said responsively rotating means in said one direction as said object enters said throat and said supporting means is configured to move away from said object to cause said object to displace said engaging means in said different direction as said object leaves said throat and as said girth loop is pulled from said supporting means to form said girth hitch on said object.

3. An apparatus according to claim 2 in which said engaging means includes a lift bracket connected to said hook element and a line secured to said lift bracket to allow recovery after said girth hitch has been made on said object.

4. An apparatus according to claim 3 in which lift bracket is provided with a hook slot, said engaging means is provided with at least one nipple leaf spring and said hook element is releaseably held in said engaging means by said at least one nipple leaf spring engaging said hook slot until said girth hitch is formed on said object and a tensile force is transmitted through said girth loop to pull said hook element from said nipple leaf spring.

5. An apparatus according to claim 4 in which said hook element is provided with a hook pin that extends through said hook slot to permit the rotation of said lift bracket to align said lift bracket so that said tensile force is transmitted through said hook element during said recovery of said object.

6. An apparatus according to claim 5 in which said supporting means is a U-shaped member with said one side surface and said other side surface being its two legs which are spaced apart sufficiently to accommodate said object.

7. An apparatus for making a girth hitch from a girth loop on an object comprising:

a fork provided with a throat sized to receive said object therein between one side surface and an other side surface;

an actuator gate rotatably mounted at said one side surface of said fork for responsively rotating when displaced in one direction by said object;

a latch ring keeper provided at said other side surface of said fork for releaseably holding a latch ring element;

a parrot hook assembly mounted on the actuator gate having a hook element for engaging said latch ring element of latch ring keeper when said actuator gate is displaced in said one direction by said object entering said throat; and a girth loop carried on said fork having a latch ring bite portion connected to said latch ring element and a hook bite portion supported on said parrot hook assembly, whereby as said object displaces said parrot hook assembly in a different direction, said hook element of said parrot hook assembly disengages said latch ring element from said latch ring keeper, said hook bite portion of said girth loop is pulled free of said parrot hook assembly and said girth loop is pulled from said fork to form said girth hitch o said object.

8. An apparatus according to claim 7 in which said fork is configured to move toward said object to cause said object to displace said actuator gate in said one direction as said object enters said throat and said fork is configured to move away from said object to cause said object to displace said parrot hook assembly in said different direction as said object leaves said throat and as said girth loop is pulled from said fork to form said girth hitch on said object.

9. An apparatus according to claim 8 in which said parrot hook assembly includes a lift bracket connected to said hook element and a line secured to said lift bracket to allow recovery after said girth hitch has been made on said object.

10. An apparatus according to claim 9 in which lift bracket is provided with a hook slot, said parrot hook assembly is provided with at least one nipple leaf spring and said hook element is releaseably held in said parrot hook assembly by said at least one nipple leaf spring engaging said hook slot until said girth hitch is formed on said object and a tensile force is transmitted through said girth loop to pull said hook element from said nipple leaf spring.

11. An apparatus according to claim 10 in which said hook element is provided with a hook pin that extends through said hook slot to permit the rotation of said lift bracket to align said lift bracket so that said tensile force is transmitted through said hook element during said recovery of said object.

12. An apparatus according to claim 11 in which said fork is a U-shaped member with said one side surface and said other side surface being its two legs which are spaced apart sufficiently to accommodate said object.

13. A method for making a girth hitch from a girth loop on an object comprising:

supporting one side surface and an other side surface having a throat sized to receive said object therein between;

rotatably displacing an actuator gate on said one side surface by said object as said object travels in one direction as it enters said throat;

releaseably holding a latch ring element at said other side surface;

engaging said latch ring element by a hook element after said rotatably displacing and said object entering said throat; and withdrawing said one side surface and said other side surface to remove said object from said throat;

tying said girth hitch on said object with a girth loop carried between said one side surface and said other side surface having a latch ring bite portion connected to said latch ring element and a hook bite portion supported on said hook element, whereby as said object displaces said hook element in a different direction, said hook element disengages said latch ring element from said other side surface, said hook bite portion of said girth loop is pulled free of said hook element and said girth loop is pulled from said supporting to form said girth hitch on said object.

14. A method according to claim 13 in which said one side surface and said other side surface are configured to move toward said object to cause said object to displace said actuator gate in said one direction as said object enters said throat and said one side surface and said other side surface are configured to move away from said object to cause said object to displace said hook portion in said different direction as said object leaves said throat and as said girth loop is pulled from said one side surface and said other side surface to form said girth hitch on said object.

15. A method according to claim 14 further including:

lifting said object via a lift bracket connected to said hook element and a line secured to said lift bracket to allow recovery after said girth hitch has been made on said object.

16. A method according to claim 15 further including:

providing a hook slot in said lift bracket and at least one nipple leaf spring in said hook element and releaseably holding said hook element by said at least one nipple leaf spring engaging said hook slot until said girth hitch is formed on said object and a tensile force is transmitted through said girth loop to pull said hook element from said nipple leaf spring.

* * * * *